US006669741B2

(12) United States Patent
Yarborough et al.

(10) Patent No.: US 6,669,741 B2
(45) Date of Patent: Dec. 30, 2003

(54) PROCESS FOR RESTORING THE NATURAL APPEARANCE OF PARA-ARAMID CLOTHING

(75) Inventors: Portia D. Yarborough, Midlothian, VA (US); Hamid Moayed Ghorashi, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 214 days.

(21) Appl. No.: 09/960,039

(22) Filed: Sep. 21, 2001

(65) Prior Publication Data

US 2003/0088922 A1 May 15, 2003

(51) Int. Cl.[7] ..... D06P 3/24
(52) U.S. Cl. ..... 8/654; 8/657; 8/925
(58) Field of Search ..... 8/925, 654, 651

(56) References Cited

U.S. PATENT DOCUMENTS

| | | | | |
|---|---|---|---|---|
| 2,424,778 | A | | 7/1947 | Tainsh |
| 3,069,223 | A | * | 12/1962 | Moroschan |
| 3,767,756 | A | | 10/1973 | Blades |
| 3,869,429 | A | | 3/1975 | Blades |
| 4,144,023 | A | | 3/1979 | Provost |
| 4,308,374 | A | | 12/1981 | Vollbracht et al. |
| 4,698,414 | A | | 10/1987 | Bair |
| 4,985,046 | A | | 1/1991 | Hartzler |
| 5,232,461 | A | | 8/1993 | Ghorashi |
| 5,660,779 | A | | 8/1997 | Bowen et al. |
| 2003/0056305 | A1 | * | 3/2003 | Capt et al. |

* cited by examiner

*Primary Examiner*—Margaret Einsmann

(57) ABSTRACT

The visual appearance of undyed or unpigmented para-aramid fabric generally present in an article of clothing is restored by contacting the fabric with an aqueous dye solution or dispersion to dye the aramid fibrils present on the yarns. Use of a conventional washing machine is suitable in the fabric contact with the dye.

14 Claims, No Drawings

PROCESS FOR RESTORING THE NATURAL APPEARANCE OF PARA-ARAMID CLOTHING

FIELD OF INVENTION

The present invention relates to a process for improving the natural appearance of an article of clothing, which comprises a yarn of para-aramid fiber. The process involves contacting undyed and non-pigmented yarn with an aqueous dye solution or dye dispersion wherein the process is particularly adaptable using a conventional washing machine.

BACKGROUND OF THE INVENTION

An important use of aramid yarn is in the manufacture of articles of clothing and particularly articles of clothing employed where resistance to cuts or lacerations and/or protection from exposure to elevated temperatures.

Typically, the articles of clothing are made from para-aramid yarns, specifically poly (p-phenylene terephthalamide), however they may also be made from a combination of para-aramid yarns such as poly (p-phenylene terephthalamide) yarn known under the designation PPD-T and non para-aramid yarn such as isophthalamide known under the designation MPD-I. Other synthetic fibers, such as nylon and polyester, and organic fibers, such as cotton, may be present in the yarns of these articles of clothing.

However, difficulties and disadvantages arise with the use of undyed or unpigmented para-aramid yarn from an appearance standpoint.

Para-aramid fiber has a highly ordered fibrillar structure with a propensity for fibrillation attributable to the lack of lateral forces between macromolecules. As the para-aramid content of a fabric increases above 5 weight percent, the extent of potential fibrillation of the para-aramid fibers also increases and actual fibrillations can become more noticeable and objectionable. With the wear, abrasion and laundering that occurs as the fabric article is used over time, fabrics lose their aesthetic appeal.

Para-aramid fibers in general and in particular, poly (paraphenylene terephthalamide) (PPD-T) fibers, have molecular features of high crystallinity, a stiff molecular chain and high interchain bonding forces resulting in high tensile strength and high modulus. However, these molecular features which provide such outstanding physical properties also result in the para-aramid fibers being quite difficult to dye. This attribute of para-aramid fiber is generally discussed in U.S. Pat. No. 4,144,023 to Provost, U.S. Pat. No. 4,985,046 to Hartzler, and U.S. Pat. No. 5,232,461 to Ghorashi, wherein various dyeing processes are disclosed.

U.S. Pat. No. 4,144,023 discloses an improved dyeing process wherein wetted aromatic polyamide fibers are crimped and maintained moist before dyeing. U.S. Pat. No 4,985,046 discloses disadvantages of "spun-in" and "structure prop" methods of dyeing poly(paraphenylene terephthalamide) fibers and discloses a process wherein specially prepared fibers (acid treated or never dried) are contacted with an aqueous solution of a dye promoting species. U.S. Pat. No. 5,232,461 discloses dyeing poly (paraphenylene terephthalamide) fibers by heating them under high pressure.

None of the U.S. Patents discussed above relate to the problem of restoring the appearance of fibrillated aromatic polyamide fibers.

Treatment of a used or worn material to adjust the color with blueing agents is described in U.S. Pat. No. 2,424,778 to Tainsh. Blueing agents are described as generally being blue colors, pigments or dyes having generally a slight reddish tint. The desired whitening effect is produced as a result of the blue and red combining with the yellowish tint of the material to give a light grey or bluish grey which looks whiter and is more pleasing to the eye than the faint yellow coloring of the untreated material.

It is desirable to have a method to restore the appearance of an undyed or non-pigmented fabric containing para-aramid yarn when such fabric loses its appearance from wear in an article of clothing, from laundering or from weaving of the fiber.

SUMMARY OF THE INVENTION

The present invention is directed to a process for restoring the appearance of an article of clothing comprising a fabric made from yarns having undyed and non-pigmented para-aramid yarn segments having fibrils comprising the steps of:

(a) contacting the article of clothing with an aqueous dye solution or dispersion to dye the para-aramid fibrils, and (b) drying the article of step (a).

DETAILED DESCRIPTION OF THE INVENTION

The starting material in the present invention is typically an article of clothing made from para-aramid yarn which is not dyed or pigmented prior to its manufacture. However in normal wear of the clothing, the clothing appearance deteriorates due to abrasion and/or due to exposure to a hostile environment. Also appearance can deteriorate due to repeated laundering.

Preferred articles of clothing of the present invention include protective apparel including cut resistant protective apparel including gloves, aprons, sleeves and fire fighting equipment which, in many instances, are made solely from para-aramid fiber. In repeated use such as with gloves, the appearance can rapidly deteriorate without affecting the durability of the glove fabric.

Also a use for clothing made from undyed and non-pigmented aramid yarn is for fire fighting equipment outer garments. The clothing encounters abrasion through surface contact and becomes dirty through normal wearing including perspiration of the wearer or often due to contact with smoke, soot and in extreme cases due to corrosive chemicals. Accordingly, such outer garments are washed in conventional washing machines employing household detergents. It has been found with para-aramid fibers, repeated washings can cause the clothing to lose its new natural appearance.

Fibrillation of para-aramid yarn results in the unattractive appearance of the clothing. While soiling of individual fibers also occurs, it is considered that fibrillation is often the predominant reason for the negative appearance.

Illustratively, a reason for the loss of the look of a new fabric is thought to be due to a difference in the light reflectance of the fibrils which partially separate from the main filament. Since the fibrils have a much smaller diameter, they reflect light differently compared to the main filaments. The fabric surface begins to look lighter in shade with portions of the fabric of different shades due to the manner light is reflected. Additionally, with a combination of different yarns, such as a non-para-aramid yarn in addition to the para-aramid yarn, the amount of fibrillation can differ. Such difference affects the visual color appearance.

Although it is well known that para-aramid yarn is difficult to impart color by dyeing or pigmenting, nevertheless it has been discovered that fibrils of the para-aramid yarn readily absorb a dye. Therefore the present invention is directed to modifying the appearance of the fibrils by dyeing such that their color and reflection of light is similar to the unfibrilated yarn which accounts for the bulk of the cloth. Use of pigment also allows a modification of appearance of the fibrils. Most gloves are made by knitting spun yarn. A few gloves are made from cut and sew of woven cloth.

The dyeing or pigmenting operation is considered to primarily affect the fibrils with little or no effect on the unfibrillated para-aramid yarn.

Therefore, the present invention in a preferred embodiment allows the wearer to restore the appearance of the article of clothing in straightforward fashion using a conventional washing machine operating at normal operating conditions. The starting material for the article of clothing is a cloth made from a non-dyed or non-pigmented para-aramid yarn. However, in certain instances the content of para-aramid fiber may be small, i.e. less than 5 percent by weight of the clothing (ignoring any additional clothing liner). In preferred embodiments the para-aramid content can predominate and approach or be at a 100% concentration particularly where cut protection is important such as in gloves, aprons and sleeves.

Useful aramids are described in greater detail in U.S. Pat. No. 3,767,756 to Blades; U.S. Pat. No. 3,869,429, also to Blades and U.S. Pat. No. 4,144,023 to Provost. Other high strength, high modulus fibers are prepared by the process of U.S. Pat. No. 5,336,734. These fibers are prepared from aromatic polyamides containing divalent aromatic radicals in which the chain extending bonds of the radicals are substantially coaxial or parallel and oppositely directed and are connected by amide (—NHCO—) linkages. The radicals may also be linked by vinylene, ethynylene, azo or azoxy radicals. A portion of the aromatic radicals may be replaced with trans-1,4-cyclohexylene radicals.

Briefly, these fibers are typically prepared by extruding the polymer through orifices in a spinneret to form individual filaments which are combined to form continuous mulifilament yarns. These yarns may be plied or wrapped with other yarns and then knitted or woven into fabrics. Alternatively, if a spun staple fiber yarn is desired, these continuous multifilament yarns can be stretch broken or cut into staple fiber and spun into staple yarns using conventional cotton system processing techniques and then knitting or weaving those yarns into fiber. The continuous multifilament yarns can also be combined with other types of multifilament yarns to form a tow. The tow can then be cut to form staple fibers which are later spun into yarns and then into fabrics using known techniques.

An article of clothing can include a high content of non-para-aramid fibers. In one embodiment of this invention the garment contains para-aramid fibers which are poly (p-phenylene terephthalamide) (PPD-T) and poly (m-phenylene terephthalamide) (MPD-1).

The type of dyes which can be suitable in the present invention are varied and include cationic, disperse or acid dyes.

However cationic dyes are preferred where they are readily soluble in water. A dye dispersion is less preferred since for optimum results such dispersion generally needs to be added to water prior to any contact with the article of clothing.

The weight ratio of dye to weight of fabric to be colored can vary over wide ranges. Dilute dye concentrations can be employed such as 0.01% based on the weight of the fabric. However it is preferred to employ concentrations in a range from 0.02 to 0.1%. An upper concentration is not critical but generally will be not more than 1% by weight. Excessive dye concentrations are not desirable since excessive dye will be discarded. Also it is within the scope of the present invention to employ multiple dyeing steps. Illustratively, dilute dye concentrations below 0.01% can be employed with a series of dyeing steps to raise the total dye concentration to at least 0.01% based on the weight of the fabric.

Generally, the dilution of the dye in water which contains the article of clothing is not critical. Generally this dilution can be expressed as the amount of water to the weight of fabric. Suitable ratios of water to fabric can range from 3:1 to 100:1 by weight.

A factor which can influence the dyeing of the fibrils is the temperature of the water for the dye solution or dye dispersion. Generally a temperature of 40° C. will be employed. An example of a suitable range is from 40 to 80° C. Temperatures in the range of 55 to 65° C. are preferred. Generally aqueous dye contact with the article of clothing will be at least 5 minutes, generally at least 10 minutes and more preferably 30 minutes. Use of a conventional washing machine can be employed.

In the process according to the invention it is not necessary to include dye assist agents in the dye solution. By dye assist agents, it is meant carriers or additional chemicals that are added to swell the fiber. Furthermore, the use of high pressure to assist in the uptake of the dye from the bath is not necessary and atmospheric conditions are preferred. Also, the use of a fluorescent agent, and particularly a blue fluorescent substance such as disclosed in U.S. Pat. No. 2,424,778 is not necessary and lies outside the scope of the present invention. Accordingly such substance lies outside the definition of a dye as employed in the present invention.

To illustrate the present invention, the following examples are provided.

All parts and percentages are by weight unless otherwise indicated. Also, all temperatures are in degrees centigrade. The color determinations were made using a Hunter Tristimulus Colorometer model D25M-9.

The color and shade depth for the various samples of fabric were determined by measuring the Hunter 'L', 'a', and 'b' values in the conventional manner. The 'L' color component is a measure of the blackness or whiteness of the sample, while the 'a' value is a measure of where the color of the sample is in the red to green range and the 'b' value is a measure of where the color of the sample is in the blue to yellow range.

In the following examples the natural color of gloves composed of 100% poly(p-phenyleneterephthalamide) (except for trim and cuffs) was restored. The treatment involved contacting the glove with an aqueous dye solution before final rinse cycle in a commercial laundering process. The natural golden color of the aramid fiber was regenerated under all water temperatures and a range of pH conditions. No dye assist agent was used in the process. After the dye contact with glove, the dye becomes non-fugitive. The treated gloves exhibited good crocking resistance-resists color transfer when rubbed. The appearance renewal process has no impact on the cut protection provided by gloves composed of the poly(p-phenyleneterephthalamide).

All gloves in the following examples were seamless knitted gloves composed of 100% poly(p-phenyleneterephthalamide) spun yarn. The cuff materials included rubber for elasticity and colored polyester thread for the overedge trim.

EXAMPLE 1

Used gloves made of poly(p-phenyleneterephthalamide) having highly fibrillated areas due to wear were placed in an aqueous bath at 66° C. containing 0.01% of Basic Yellow 40 (Classic Yellow 10 GFF 100%) dye by weight based on the weight of the glove. The glove was contacted with the aqueous dye solution for 30 minutes followed by a post-scour treatment using 1% (owf) of a 10% detergent solution of hexylene glycol at 100% strength at 60° C. for 10 minutes. The gloves were rinsed thoroughly with water and dried using forced hot air (100° C.) for 15 minutes. Color readings taken before and after treatment are shown in the table below. The b* value indicates the extent of yellow coloration. This process allows restoration of the natural yellow color. For example 1 and the following the target b* value is at least 44 provides the desired appearance.

| Used glove | L* | a* | b* | C* | h |
|---|---|---|---|---|---|
| Before treatment | 79.98 | −3.68 | 37.97 | 38.14 | 95.53 |
| After treatment | 76.03 | −2.18 | 44.53 | 44.59 | 92.80 |
| New glove | 82.00 | −5.69 | 47.29 | 47.63 | 96.87 |

EXAMPLE 2

Used gloves made of poly(p-phenyleneterephthalamide) having highly fibrillated or worn areas were placed in an aqueous dye bath containing Basic Yellow 21 (Basacryl X7GLS 200%) and Basic Yellow 29 (Sevron Yellow 60L 200%) dyes. The total dye concentration was 0.025% by weight based on the weight of the glove. The temperature of the dye bath was 66° C. The gloves were contacted with the aqueous dye solution for 30 minutes followed by a post-scour treatment using 1% (owf) of a 10% detergent solution of hexylene glycol at 100% strength at 60° C. for 10 minutes. The gloves were dried for 15 minutes using forced air heated to 100° C.

| Used glove | L* | a* | b* | C* | h |
|---|---|---|---|---|---|
| Before treatment | 76.33 | −6.41 | 34.93 | 35.52 | 100.40 |
| After treatment | 73.75 | −1.45 | 48.51 | 48.54 | 91.69 |
| New glove | 82.00 | −5.69 | 47.29 | 47.63 | 96.87 |

EXAMPLE 3

Used gloves having highly fibrillated areas were placed in an aqueous bath containing Basic Yellow 21 (Basacryl X7GLS 200%) and Basic Yellow 29 (Sevron Yellow 60L 200%) dyes. The total dye concentration was 0.025% by weight based on the weight of the glove. The temperature of the aqueous bath was varied from 55 to 77° C. The pH levels were adjusted to pH 4, 6 or 9 using acetic acid or sodium carbonate. The gloves were contacted with the aqueous dye solution for 20 minutes followed by post-scour treatment using 1% (owf) of a 10% detergent solution of hexylene glycol at 100% strength at 600° C. for 10 minutes. The gloves were dried for 15 minutes using forced air heated to 100° C. Uniform dyeing was obtained under hot and cold water temperatures and various pH levels.

| Used glove | L* | a* | b* | C* | h |
|---|---|---|---|---|---|
| Before treatment | 75.54 | −5.69 | 33.22 | 33.70 | 99.71 |
| After treatment 55° C. pH 9.5 | 70.35 | −0.25 | 44.55 | 44.55 | 90.32 |
| Before treatment | 74.53 | −6.30 | 32.67 | 33.27 | 100.92 |
| After treatment 77° C. pH 9.5 | 71.39 | 0.10 | 45.44 | 45.44 | 89.87 |
| Before treatment | 75.18 | −5.61 | 33.99 | 34.45 | 99.37 |
| After treatment 55° C. pH 6.3 | 71.50 | 0.15 | 45.33 | 45.33 | 89.81 |
| Before treatment | 74.15 | −6.35 | 32.10 | 32.72 | 101.19 |
| After treatment 77° C. pH 6.3 | 69.19 | 1.11 | 44.21 | 44.23 | 88.56 |
| Before treatment | 75.42 | −5.96 | 33.13 | 33.66 | 100.20 |
| After treatment 55° C. pH 4.3 | 71.54 | −0.73 | 44.17 | 44.18 | 90.95 |
| Before treatment | 74.62 | −6.14 | 32.65 | 33.22 | 100.66 |
| After treatment 77° C. pH 4.3 | 69.19 | 1.11 | 44.21 | 44.23 | 88.56 |

EXAMPLE 4

Gloves composed of poly(p-phenyleneterephthalamide) were contacted with an aqueous dye solution having a total concentration of 0.05% by weight based on the weight of the glove. A combination of Basic Yellow 21 (Basacryl X7GLS 200%) and Basic Yellow 29 (Sevron Yellow 60L 200%) dyes were used. The gloves were placed in the aqueous bath heated to 66° C. for 15 minutes. Following treatment, the gloves were post-scoured using 1% (owf) of a 10% detergent solution of hexylene glycol at 100% strength at 60° C. for 10 minutes. The gloves were rinsed thoroughly with water and dried using forced hot air (100° C.) for 15 minutes.

The cut performance and abrasion of the gloves were measured according to ASTM 1790-97 and ASTM 3880, respectively. No deleterious effect was observed on the cut protection performance or the abrasion after laundering treatment.

| | CPPT (g to cut 1 inch) | Abrasion (cycles) |
|---|---|---|
| Untreated glove | 1.4 | 570 |
| Treated glove | 1.4 | 680 |

What is claimed is:

1. A process for restoring the appearance of an article of clothing comprising a fabric made from yarns having undyed and non-pigmented para-aramid yarn segments having fibrils comprising the steps of:

(a) contacting the article of clothing with an aqueous dye solution or dispersion to dye the para-aramid fibrils a color equivalent to the color of the undyed and non-pigmented yarn utilizing a washing machine employing a temperature of 40° C. to 80° C., and (b) drying the article of step (a).

2. The process of claim 1 wherein the aramid comprises a para-aramid content in the article of clothing of at least 5 percent by weight.

3. The process of claim 2 wherein the para-aramid is poly(paraphenylene terephthalamide).

4. The process of claim 1 wherein the aqueous dye solution or dispersion does not employee a dye assist agent.

5. The process of claim 1 wherein an aqueous dye solution is employed.

6. The process of claim 1 wherein the initial dye concentration is at least 0.01% by weight based on the article of clothing.

7. The process of claim 6 wherein the initial dye concentration is in a range from 0.02 to 0.1%.

8. The process of claim 1 wherein the dye is a cationic dye.

9. The process of claim 1 wherein the article of clothing is protective apparel.

10. The process of claim 9 wherein the article of clothing is cut resistant.

11. The process of claim 1 wherein the article of clothing is a glove.

12. The process of claim 1 wherein the article of clothing is an apron.

13. The process of claim 1 wherein the article of clothing is a sleeve.

14. The process of claim 1 wherein the article of clothing is a fire fighting outergarment.

* * * * *